US009151195B2

(12) United States Patent
Stätter et al.

(10) Patent No.: US 9,151,195 B2
(45) Date of Patent: Oct. 6, 2015

(54) SEPARATOR WALL FOR A CRANKCASE

(75) Inventors: Mathias Stätter, Friedrichshafen (DE); Josef Walter Hausknecht, Friedrichshafen (DE); Robby Gerbeth, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 144 days.

(21) Appl. No.: 13/882,245

(22) PCT Filed: Oct. 21, 2011

(86) PCT No.: PCT/EP2011/005311

§ 371 (c)(1),
(2), (4) Date: Jul. 9, 2013

(87) PCT Pub. No.: WO2012/055515

PCT Pub. Date: May 3, 2012

(65) Prior Publication Data

US 2013/0276743 A1 Oct. 24, 2013

(30) Foreign Application Priority Data

Oct. 28, 2010 (DE) ..... 10 2010 043 060

(51) Int. Cl.
*F01M 13/02* (2006.01)
*F01M 11/03* (2006.01)
(Continued)

(52) U.S. Cl.
CPC ..... *F01M 11/00* (2013.01); *F01M 13/0405* (2013.01); *F01M 2013/0072* (2013.01);
(Continued)

(58) Field of Classification Search
CPC ..... F01M 13/022; F01M 11/03; F01M 1/10; F01M 13/04; F01M 13/00; F01M 13/021; F16H 57/02; F16H 57/027; F16N 19/005; F02D 17/04; F01L 1/00; F01L 1/02; F02M 25/06
USPC ..... 123/198 P, 196 A, 196 DA, 198 DA
See application file for complete search history.

(56) References Cited

U.S. PATENT DOCUMENTS 2,493,617 A * 1/1950 Chubbuck ..... 123/573
3,824,973 A 7/1974 Harhaus
(Continued)

FOREIGN PATENT DOCUMENTS

DE 234479 C 2/1910
DE 19 95 271 U 10/1968
(Continued)

OTHER PUBLICATIONS

PCT International Search Report dated Mar. 1, 2012 for PCT/EP2011/005311.
(Continued)

*Primary Examiner* — Lindsay Low
*Assistant Examiner* — Syed O Hasan
(74) *Attorney, Agent, or Firm* — Fishman Stewart Yamaguchi PLLC

(57) ABSTRACT

A crankcase for an internal combustion engine, having a suction arrangement which is assigned to the crankcase and is configured for ventilating the crankcase of blow-by gas, in particular a gas/oil mixture, to produce a limited vacuum in the crankcase is disclosed. The crankcase has at least one dividing wall which is configured to feed blow-by gas and to separate oil. A ventilating housing part and a carrier housing part which is arranged above the ventilating housing part in included in the crankcase. The dividing wall is formed between the ventilating housing part and the carrier housing part and a suction arrangement is formed in the form of a suction jet pump which is configured for extracting oil from the dividing wall.

19 Claims, 2 Drawing Sheets

(51) Int. Cl.

| | |
|---|---|
| ***F01M 11/00*** | (2006.01) |
| ***F01M 13/00*** | (2006.01) |
| ***F02B 25/06*** | (2006.01) |
| ***F01M 13/04*** | (2006.01) |

(52) U.S. Cl.
CPC ..... *F01M2013/0427* (2013.01); *F01M 2013/0433* (2013.01); *F01M 2013/0438* (2013.01); *F01M 2013/0461* (2013.01); *F01M 2013/0488* (2013.01)

(56) References Cited

U.S. PATENT DOCUMENTS

| | | | | |
|---|---|---|---|---|
| 4,557,226 | A * | 12/1985 | Mayer et al. | 123/41.86 |
| 2004/0069287 | A1 * | 4/2004 | Matsuda et al. | 123/573 |
| 2004/0261775 | A1 * | 12/2004 | Mashiko | 123/572 |
| 2010/0043734 | A1 | 2/2010 | Holzmann et al. | |

FOREIGN PATENT DOCUMENTS

| | | | |
|---|---|---|---|
| DE | 28 45 955 | A1 | 4/1979 |
| DE | 197 01 977 | A1 | 7/1998 |
| DE | 101 28 465 | A1 | 1/2003 |
| JP | 63 158509 | U | 10/1988 |
| WO | WO-2009014772 | A1 | 1/2009 |

OTHER PUBLICATIONS

German PTO Office Action dated Jun. 22, 2011 for DE102010043060.9.

* cited by examiner

SEPARATOR WALL FOR A CRANKCASE

CROSS REFERENCE TO RELATED APPLICATIONS

This application is a National Phase Application related to PCT/EP2011/005311 filed on Oct. 21, 2011, which application claims priority to DE 10 2010 043 060.9 filed on Oct. 28, 2010, which applications are incorporated herein by reference in their entirety.

TECHNICAL FIELD

The disclosure relates to a crankcase for an internal combustion engine, whereby a suction arrangement configured to ventilate the crankcase of blow-by gas, particularly a gas/oil mixture, and to generate a limited vacuum in the crankcase is included, and wherein at least one separation wall is provided that is configured to direct the flow of blow-by gas and separate oil from same.

BACKGROUND

A problem created in a crankcase as the result of blow-by gases mixed with oil is known, by way of example, from DE 234479. In internal combustion engines, it is fundamentally impossible to avoid the passage of a certain amount of combustion gases mixed with oil or liquid fractions of oil between a working piston and a combustion cylinder, into an interior space of the crankcase. The abovementioned document suggests suctioning off corresponding blow-by gases via a fan. In order to prevent oil fractions from depositing in the fan or in subsequent connector parts, the prior art document suggests attaching a cooler in the form of the fan for the purpose of allowing the oil fractions to condense. The condensed oil fractions are made usable once more by the same flowing back into the crankcase by means of gravity in a suitable uptake tube. However, the problem with this approach is that the separation of oil from the blow-by gas must take place at a position in the crankcase with a sufficient geodetic height to enable the gravity-supported return flow of the oil.

One solution known from DE 2845955 works around this problem by suctioning the blow-by gas along with the oil vapors out of the crankcase and into a forced circulation loop of one of the media of the engine. For this purpose, a Venturi tube is arranged in the oil system between the oil pressure outlet for the lubricating oil and the oil pan. A Venturi tube can alternatively be arranged in a loop of the precompression air as well, such that the oil vapor is carried by the flow of the precompression air, and in this manner is routed back into the cylinder. The latter can also be configured to utilize an auxiliary line excluded from the force circulation loop. However, this configuration has the problem that—as mentioned above—the oil fractions in the blow-by gas contaminate the subsequent fans, compressor, and other lines and means of conveyance in the forced circulation loop.

The above mentioned disadvantages can be avoided by a proposed separation wall for the routing of blow-by gas and the separation of oil. A suitable separation wall is included in DE 10128465 A1, by way of example, and is formed by means of a vaned wheel arranged radially to a crankcase. In a principally advantageous manner, this solution is based on the concept of evacuating the blow-by gas from the crankcase while separating oil out of the blow-by gas. Such a conceptualization prevents the very undesirable contamination of the periphery of an internal combustion engine. However, it is desirable to implement this concept in a simplified manner.

SUMMARY

The present disclosure addresses the problem of providing a crankcase for an internal combustion engine, as well as an internal combustion engine, wherein a blow-by gas can be ventilated from the crankcase while separating out oil fractions in an improved manner. In particular, it should be possible in a comparatively simple and compact manner to implement a device in a crankcase for the ventilation of blow-by gases while separating out oil. In particular, the disadvantages present in the prior art should be avoided. In particular, a return of oil separated from the blow-by gas should occur in a comparatively simple manner. For this purpose, the return should be possible without support from gravity.

The problem as concerns the crankcase for an internal combustion engine is addressed in a first variant by a crankcase of the class indicated above, wherein according to an exemplary configuration, a ventilation housing part and a support housing part arranged over the same is included. A separation wall is formed between the ventilation housing part and the support housing part. A suction arrangement is constructed in the form of an ejector pump which is configured to suction out oil from the separation wall. The suction arrangement may be constructed as the suction arrangement assigned to the crankcase as indicated above. The suction arrangement according to one exemplary arrangement may also be constructed as an additional—meaning further—suction arrangement. In addition, an internal combustion engine having a crankcase according variations of the disclosure is also described herein.

The exemplary arrangements of the disclosure proceed from the thinking that a ventilation of blow-by gas from the crankcase, while separating off oil, offers a fundamentally advantageous concept both for making separated oil usable for the operation of the internal combustion engine once more, and also for preventing the contamination of the surroundings of the internal combustion engine with separated oil. The disclosure is also based on the realization that, up to now, concepts which implement this approach still include a return feed of the oil which stands to be improved. The disclosure according to a first variant is based on the realization that it is fundamentally advantageous as regards the implementation of the concept to include a ventilation housing part and a support housing part arranged over the same for the ventilation of blow-by gas from the crankcase while separating off oil. In addition, the disclosure is based on the realization that a separation wall between the ventilation housing part and the support housing part can be used advantageously to enable an improved oil return feed. The disclosure includes a suction arrangement in the form of an ejector pump which is designed for suctioning off oil from the separation wall. In other words, the concept of the disclosure according to the first variant includes the separation wall between the ventilation housing part and the support housing part in a synergistic manner, in such a way that oil separated thereon can collect in order to be suctioned off by an ejector pump which is advantageously included. According to the second variant of the disclosure, this concept can be implemented in relation to any arbitrary separation wall which has an oil receiving area situated in the base portion of a chamber which conveys blow-by gas.

The concept of the disclosure therefore enables a return feed of oil which is predominantly independent of the assistance of gravity, because the ejector pump can achieve the return feed of the oil when suctioning off the separated oil from the separation wall even if the crankcase is tilted, or there are other circumstances which reduce the supportive effect of gravity. In addition, the concept of the disclosure offers a comparatively simple approach to implementing a suction arrangement and a return feed line in the crankcase. As such, the suction arrangement in the form of an ejector pump, and a corresponding return feed path can be integrated in a particularly advantageous manner entirely, and in any case in part, in a wall of a crankcase.

In addition, an ejector pump offers a wide variety of different options according to design requirements for operation using a motive fluid. In other words, the arrangement including a separation wall and ejector pump can be freely and compactly positioned independently of the surroundings of the internal combustion engine. The ejector pump can be driven by a motive fluid which can be advantageously composed according to requirements. Overall, the concept of the disclosure as named above offers a comparatively simple solution for the ventilation of blow-by gas from a crankcase while separating off oil.

Implementations of the disclosure may be found in the dependent claims and provide advantageous detailed options for the realization of the concept—as explained above—within the context of the problem addressed by the disclosure, as well as in regards to further advantages.

In one exemplary concept implementation, the arrangement comprising the separation wall and the suction arrangement is realized as part of a crankcase designed for the single-stage or two-stage separation of oil. The oil separation may be realized as a two-stage separation of oil by a pre-stage oil separation and a primary oil separation. The arrangement comprising a separation wall and an ejector pump improves the fundamental known concept of a ventilation of blow-by gas while separating off oil, in an advantageous manner.

In particular, to implement the concept, the ventilation housing part is designed for a separation of oil. For this purpose, the ventilation housing part can have a first and a second chamber, in a particularly advantageous manner, wherein said chambers are separated by a first oil separation—particularly a pre-stage oil separation. In one exemplary particularly advantageous realization of this implementation, for this purpose the first chamber is arranged below the second chamber. In addition, the second chamber is advantageously constructed directly below the separation wall between the ventilation- and support housing components. The separation wall in this implementation is accordingly included for the purpose of feeding blow-by gas out of the second chamber—meaning routing blow-by gas after a separation of oil from the same. This has the advantage that a significant part of the oil can already be separated off in the pre-stage oil separation in the first chamber of the ventilation housing part, and preferably can flow back into the crankcase interior of the crankcase.

As an alternative or in addition—following the concept of the second variant of the disclosure—a further ejector pump and/or a further feed channel can be included in the pre-stage oil separation, for example integrated into a further separation wall between the first or the second chamber, in order to support a return feed of the oils separated off in the pre-stage oil separation into the crankcase. In this case, the pre-stage oil separation is independent—in an improved manner—from a gravity supported return feed of the oil.

In one exemplary configuration, the first oil separator—preferably the pre-stage oil separator—may be advantageously constructed as a part of the further separation wall, as mentioned above, with a labyrinth separator or fiber separator or the like. A first oil separator of this type can be implemented in an advantageous manner, and comparatively easily, as a part of the further separation wall between a first and a second chamber of the ventilation housing part.

Moreover, the support housing part may be configured for the purpose of supporting superstructural engine components, and particularly a turbocharger, in an advantageous manner. In addition or as an alternative thereto, it is also possible to design the support housing to have an oil separating function, to implement a two-stage oil separation. The support housing may particularly support a second oil separator. The second oil separator may be advantageously configured as a cyclone oil separator. This has the advantage that oil separated in the second oil separator implemented in the support housing—preferably the primary oil separation—can now be directly fed to the separation wall.

It has proven advantageous to design the support housing part for an oil separation. By including a chamber in the support housing part for receiving oil on the separation wall, in the present case—particularly the primary oil separation—the separation wall serves to collect the majority of the oil.

In one particularly preferred implementation according to the second variant of the disclosure, which implements the concept according to the disclosure several times over, both the separation wall and an optionally present wall, which is particularly a bottom wall of the ventilation housing part, are designed for the purpose of suctioning off oil by means of one or more ejector pumps, in order to optionally enable a gravity-dependent return feed of oil into the crankcase.

In a particularly preferred exemplary implementation, the separation wall is constructed as a bottom wall of the support housing part. The wall mentioned above of the ventilation housing part is advantageously constructed as a bottom wall of the ventilation housing part. The separation wall of the disclosure—which is a general bottom wall or a chamber in the upper ventilation area of the crankcase—is advantageously oriented substantially horizontally. The separation wall is particularly included between the ventilation housing part and the support housing part running horizontally. In particular, a further separation wall of the ventilation housing part is also included between the ventilation housing part and the upper part of a crankcase interior of the crankcase. The separation wall—particularly in general a bottom wall—advantageously comprises an oil collection area.

In one advantageous constructive realization of the concept of the disclosure, a feed channel which departs from the oil collection area is designed for the feed of oil to an ejector pump. A feed channel can particularly be integrated at least in part into the separation wall. An ejector pump can be arranged in a particularly advantageous manner in a wall of the ventilation housing part. The constructive implementations named above can be implemented inside a crankcase in a comparatively compact manner. As such, external lines and separate suction means are advantageously avoided.

According to the design of an internal combustion engine, advantageous options for the connection of a motive fluid stream to the ejector pump exist. A motive fluid stream can be fed by means of a suitable feeding of motive fluid to the ejector pump. A motive fluid stream comprising fluid—for example a charge fluid, and particularly supercharger air—can preferably be fed to the ejector pump. As an alternative, a motive fluid stream comprising another oil, and particularly an engine lubricating oil, can be fed to an ejector pump. It is possible to operate an ejector pump using such a motive fluid stream, or another motive fluid stream, in a particularly advantageous manner, in order to suction off oil separated by the separation wall.

Charge fluid, and advantageously supercharger air, particularly achieves an improvement in the degree of efficiency as a motive fluid for the ejector pump, because the separated oil is raised to a higher, and in any case wider, temperature level. Because oil is less viscous at higher temperatures, a fundamentally improved degree of efficiency results for the return oil feed.

In one implementation, it is possible to accommodate one or more ejector pumps—and particularly as an additional suction arrangement in addition to the suction arrangement which is functionally assigned to the crankcase—in a wall of the crankcase. In a constructively advantageous manner, it is possible to feed a motive fluid stream of the ejector pump together with the separated oil directly or indirectly to a crankcase interior of the crankcase. Particularly for this purpose, the feed channel opens into the crankcase interior and/or is guided into the same via the ejector pump.

In one particularly preferred implementation, the distribution channel is guided in a wall of the crankcase. In a particularly preferred manner, the feed channel has a first horizontal section in the bottom wall of the support housing part, and a second horizontal section in the wall of the ventilation housing part. The first and second horizontal sections are preferably connected to each other by a transverse section. The second horizontal section is preferably integrated in a roof wall of the ventilation housing part, and particularly in a roof wall of the first chamber of the ventilation housing part, as named above. The transverse section is preferably integrated in a lateral wall of the ventilation housing part, and particularly in a lateral wall of the second chamber of the ventilation housing part as named above. In this manner, it is possible to realize the feed channel in an approximately z-shaped [sic]—and particularly with at least one bend, particularly a 90° bend—in a manner which is advantageous for the return feed of oil.

It is principally possible to realize a comparatively shorter conduit path for the return feed of separated oil into the crankcase by integrating the feed channel and/or the ejector pump into a wall of the crankcase—because the feed channel is then guided very near to the crankcase. The configuration should concretely avoid an external line, which conventionally would run from a maximum point of the crankcase to an oil pan. Instead, the feed channel runs from an oil separator in the ventilation—and/or support housing directly to the ejector pump in a wall of the crankcase. The feed channel can advantageously be integrated into a cast part of the crankcase. In addition, the ventilation housing part and the support housing part can advantageously be constructed as a single cast part. Such or similar implementations realize a comparatively simple and compact solution for the return feed of oil—which is also cost-effective. A return feed of oil which does not rely on gravity offers an oil return feed which works without failure regardless of the tilt of the engine. In particular, costly inclination testing can be dispensed with during the certification of a corresponding internal combustion engine.

The present concept of the disclosure and the various implementations thereof are described in the context of a crankcase, wherein the feed channel and/or the ejector pump are particularly integrated into a wall of the crankcase. In total, the concept of the disclosure includes such and similar implementations which include an integration of a feed channel and/or an ejector pump in a wall of the crankcase, particularly the ventilation housing part and/or support housing part. In the scope of the disclosure, it is equally possible to integrate a feed channel and the ejector pump in a wall of a support housing, particularly a support housing part, for an exhaust gas turbocharger or the like.

Embodiments of the disclosure will now be described with reference to the figures. These are not intended to necessarily illustrate the embodiments in a comprehensive manner; rather, the drawings are presented in schematic and/or slightly distorted form if such is serviceable to the explanation. Reference is hereby made to the relevant prior art for complementary teaching in addition to that which can be taken directly from the figures. Herein, it should be noted that numerous modifications and alterations regarding the form and the details of any embodiment can be undertaken without deviating from the general idea of the disclosure. The features of the disclosure disclosed in the description, in the drawings, and in the claims can be essential for the implementation of the disclosure either individually or in any possible combination. In addition, all combinations of at least two of the features disclosed in the description, in the drawings, and/or in the claims fall within the scope of the disclosure. The general idea of the disclosure is not limited to the exact form or the detail of the preferred embodiments shown and described below, or to a subject matter which would be restricted compared to the subject matter claimed in the claims. Where measurement ranges are given, values lying within the named boundaries should also be considered as disclosed boundaries, and can be used and claimed in any manner. For reasons of simplicity, the same reference numbers are used below for identical or similar parts or for parts having identical or similar functions.

BRIEF DESCRIPTION OF THE DRAWINGS

Additional advantages, features, and details of the disclosure are found in the following description of the preferred exemplary embodiments, as well as in the context of the illustrations, wherein.

DETAILED DESCRIPTION

Figure 1:
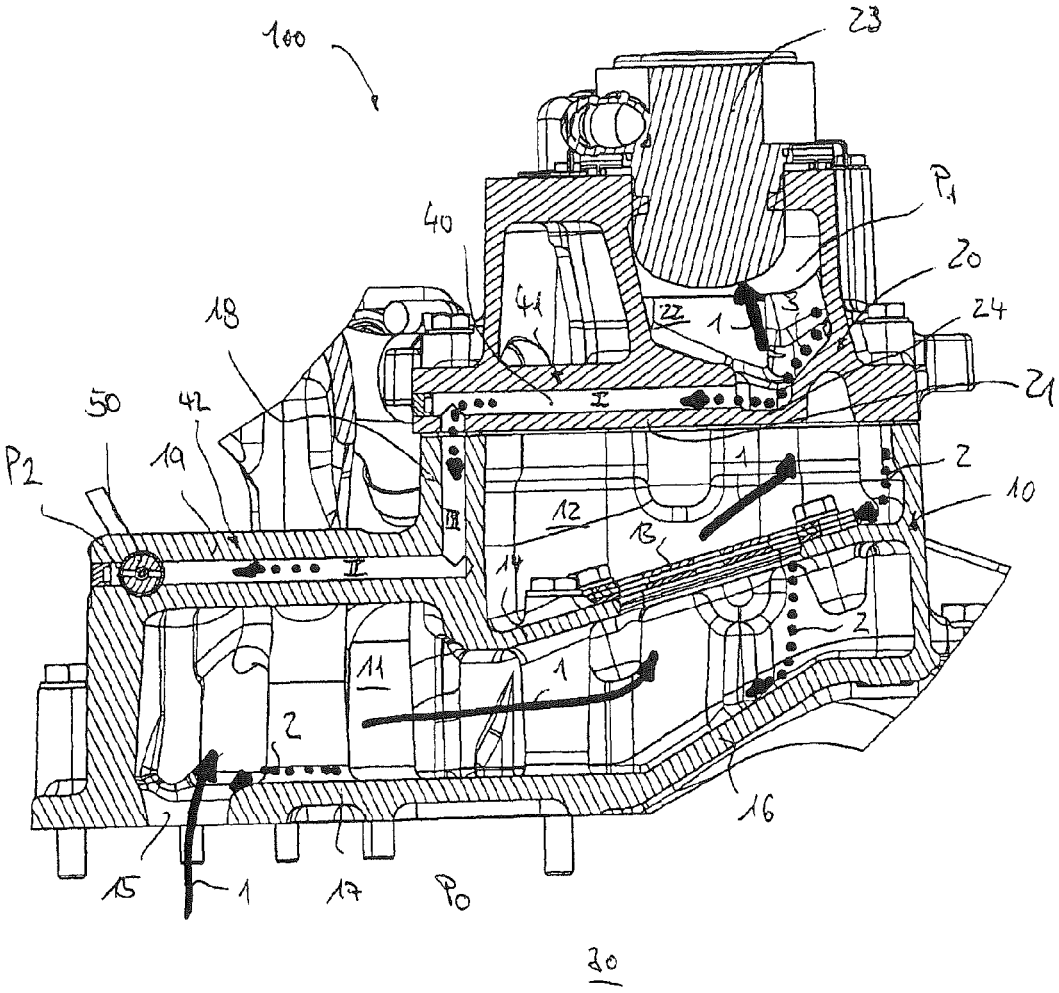
FIG. 1 shows a lateral cutaway view of an upper part of a crankcase, particularly a lateral cutaway view of a ventilation housing part and a support housing part, wherein the same are designed for the separation of oil, and wherein according to the concept of the disclosure, an ejector pump is included for suctioning off oil from a separation wall between the ventilation housing part and the support housing part.

FIG. 1 shows a crankcase 100 for an internal combustion engine, which is not shown. In the present case, the upper part of the crankcase 100 is illustrated having a ventilation housing part 10 and a support housing part 20 arranged above the same. Below the ventilation housing part 10 is situated the crankcase interior 30 of the crankcase 100, in which the cylinder heads, the crankshaft, and finally an oil sink are arranged one below the other, in the present case. Blow-by gases 1 mixed with oil are conveyed in this case from the crankcase interior 30 to the highest point in the crankcase 100 via one or multiple channels. In principle, such channels—which are not illustrated here—can either be integrated into the cast crankcase or designed as an external channel—such as a tube or a pipe conduit or the like. The introduction of the blow-by gases 1 into the ventilation housing part is realized through an opening 15 which is substantially protected from splash oil. The further construction of both the ventilation housing part 10 and the support housing part 20 serves the purpose of implementing a two-stage oil separation. For this purpose, the ventilation housing part 10 is designed for a pre-stage oil separation. The support housing part 20 is designed for a primary oil separation.

The conveyance of blow-by gases 1 in the direction of flow, which is symbolically illustrated here with solid arrows, is realized in that a limited, minimal vacuum P1 is applied to the support housing part 20, and is lower than the average pressure P0 in the crankcase interior 30. By way of example, in the present case a minimal vacuum of P1=−15 mbar can be set. The average pressure in the crankcase interior 30 is approximately 0 bar, but can also have a slight negative value. In this case, the fundamental concern is that P1<P0 in order to ensure a conveyance of the blow-by gases 1 from the crankcase interior 30 through the ventilation housing part 10 and into the support housing part 20. According to the disclosure—and particularly in the case of a large diesel engine for which the present crankcase 100 is described—approximately 10 g of oil is transported with a volume of the blow-by gas of approximately 500 l. This oil is separated in the two-stage oil separation of the ventilation housing 10 and the support housing 20 mentioned above, and returned to the crankcase 30.

More specifically, the ventilation housing 10 has a first chamber 11 and a second chamber 12 arranged above the same, for this purpose, and these are separated by a first oil separator 13. In the present case, the first oil separator 13 is constructed in the manner of a flat labyrinth separator having an enlarged surface, wherein the enlarged surface forms obstacles for the blow-by gases 1 in the direction of flow of the blow-by gases 1. If the blow-by gas 1 flows through the oil separator 13, then oil 3 separates out in drops and/or is deposited as a result of the loss of velocity upon encountering the obstacles. The first oil separator 13 is constructed in the present case in a particularly advantageous manner as part of a further separation wall 14 which divides the first chamber 11 and the second chamber 12 of the ventilation housing part 10. The second chamber 12 is constructed above the first chamber 11 and is smaller than the same—and also displaced laterally, as is the further separation wall 14, to the opening 15 mentioned above. The first chamber extends under the second chamber 12, beyond the same laterally, to the opening 15 mentioned above. Both a bottom wall 16 of the first chamber 11 and the further separation wall 14, the same comprising the oil separator 13 of the second chamber 12, run at an incline. The bottom wall 16 of the first chamber 11 continues in a part of the first chamber 11 which extends approximately laterally to the second chamber 12 as a substantially horizontal oil collection area 17. Because of this arrangement, during a pre-stage oil separation implemented in the ventilation housing part 10, a significant first fraction 2 of the separated oil is returned to the crankcase 30 already at this point. This fraction 2 of the separated oil is primarily composed of a fraction which is separated off in the second chamber 12, and a fraction which is separated off in the first chamber 11 and/or in the oil separator 13. The fraction 2 of the oil which is separated off in the second chamber 12, as well as the fraction 2 which is separated off in the first chamber 11 can flow back to the substantially horizontal oil collection area 17 via the inclined separation walls 16, 14 mentioned above, and be returned once more to the crankcase 30 via the opening 15 mentioned above.

A remaining portion of the non-separated oil remaining in the blow-by gas 1 is carried into the support housing part 20 with the blow-by gas 1 from the ventilation housing part 10 through a separation wall 21 according to the concept of the disclosure—particularly following the pressure gradient downward towards the lowest pressure P1. The separation wall 21 is formed in the present embodiment as a part of the support housing part 20. In an alternative embodiment not described here, the separation wall can be constructed as a top wall of the ventilation housing part 10. In a modified alternative embodiment not described here, the ventilation housing part 10 and the support housing part 20 can also be constructed as integral components of the remaining crankcase 100—for example as a single cast part together with the crankcase 100.

In the present case, the remaining fraction of the blow-by gas 1 entering the support housing part 20 is fed to a second oil separator 23 which is designed as a cyclone oil separator in the present case. In the present case the support housing part 20 supports both the second oil separator 23 and engine installations which are not illustrated here in greater detail, such as a turbocharger or the like. In addition, the second support housing part 20 is designed for the purpose of separating oil out of the blow-by gas 1. The support housing part 20 particularly has a chamber 22 for this purpose which is designed to receive the oil 3 separated out of the blow-by gas 1. The chamber 22 particularly has a further oil collection area 24 on the separation wall 21. The separated oil 3 from the cyclone separator can therefore be returned to the chamber 22 of the support housing part 20. The walls of the chamber 22 have an advantageous geometrical shape—in this case approximately funnel-shaped—for supporting the return feed of oil, such that effectively the full amount of the separated oil 3 can collect on the separation wall 21 in the further oil collection area 24 of the chamber 22.

The separation wall 21 runs substantially horizontally between the ventilation housing part 10 and the support housing part 20 alongside the further oil collection area 24, in the direction of a feed channel 40. The feed channel 40 accordingly runs substantially horizontally in a material region 41 of the support housing part 20 which forms the separation wall 21. The material region 41 can be designed as a cast region, by way of example—as can the entire support housing part.

Overall, the separation wall 21 forms a bottom wall of the support housing part 20 as a part of the material region 41 in the embodiment of the disclosure shown in the present case in FIG. 1, in an advantageous implementation of the concept of the invention, wherein the feed channel 40 is integrated into the separation wall 21—specifically in the material region 41. The further route of the feed channel 40 is integrated in a material region 42 of the ventilation housing part 10 which forms the lateral wall 18 of the second chamber 12 and the top wall 19 of the first chamber 11. The route of the ventilation channel 40 along the separation wall 21, the lateral wall 18, and the top wall 19 forms a first horizontal section I and a second horizontal section II, wherein the first horizontal section is constructed in the separation wall 21, and the second horizontal section II is constructed in the top wall 19. The first horizontal section I and the second horizontal section II are connected to each other by a transverse section III. In this way, the separated oil 3 can reach the oil collection area 24 and from there the feed channel 40—namely in the horizontal section I, the transverse section III, and the second horizontal section II—from the chamber 22, along a largely steep gradient.

A vacuum P2 is applied to the feed channel 40, and this vacuum [P2] is in turn a lower pressure than the vacuum P1. In the present case, the vacuum P2 can be −100 mbar, for example. Regardless of the direction of flow, as supported by gravity, of the separated oil 3—as described above—in the present embodiment the oil 3 is suctioned out of the oil collection area 24 into the feed channel 40 and conveyed in the direction of the pressure gradient—meaning towards the vacuum P2. A suction arrangement in the form of an ejector pump 50 serves the purpose of applying the indicated vacuum to the feed channel 40, and is designed accordingly to suction the oil 3 from the separation wall 21.

Figure 2A:
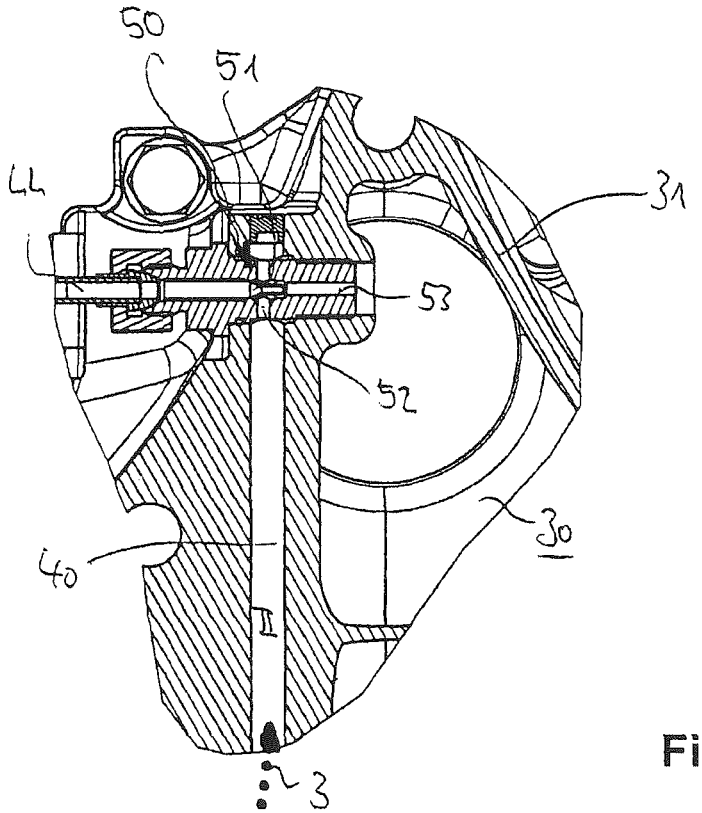
FIG. 2A shows a top view of a further cutaway view of a detail shown at left in FIG. 1 in the region of the ejector pump, in a top view.
Figure 2B:
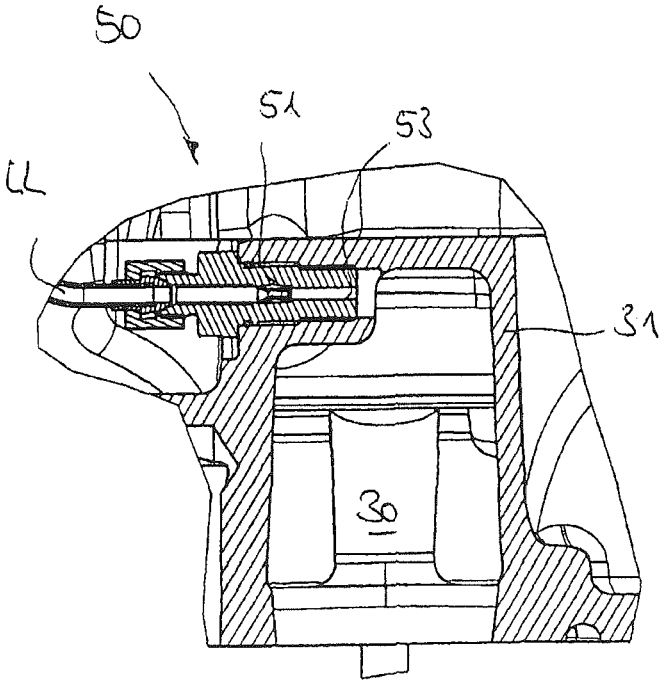
FIG. 2B shows a further cutaway view of the detail in the region of the ejector pump in FIG. 1, in the direction of the feed channel for the separated oil.

In the context of FIG. 2A and FIG. 2B, the ejector pump 50 is operated with a motive fluid stream of supercharger air LL. Due to the turbocharger arranged on the support housing part 20, the charge air LL is available directly proximate to the ejector pump 50, and is particularly advantageously suitable for the operation of the ejector pump 50. The suction arrangement described in this case as an ejector pump 50 is to be understood in the most general sense as a suction arrangement with no moving parts, which works with a motive fluid stream as the drive, per the Venturi principle. In the present case, the motive fluid stream is fed to the motive fluid nozzle 51 of the ejector pump 50 from the charge air LL, and exits the nozzle with a sufficient speed to create a sufficiently high vacuum P2 to carry an additional volume along with it out of the feed channel 40 by means of internal friction and turbulent mixing. In the present case, the separated oil 3 disposed in the feed channel 40 is suctioned by the motive fluid stream from the charge air LL and primarily introduced into the return feed channel 53 of the ejector pump 50 via the nozzle region 52. The oil 3 is finally returned to the crankcase interior 30 in the region of the nozzle opening via the return feed channel 53, the same connecting to the motive fluid nozzle 51. The region of the nozzle opening and/or the return feed channel 53 in the present embodiment is particularly advantageously arranged directly opposite a counter-wall 31 of the crankcase, said counter-wall [31] being designed as an impact surface. Depending on the velocity drop thereof at the impact surface 31, the return oil 3 is immediately deposited and/or precipitated, and can flow back into the crankcase 30 particularly quickly.

The use of charger air LL as the motive fluid in the present case achieves a significant improvement in the degree of efficiency of the oil return feed, because a broader, and optionally higher temperature level is applied to the oil 3 due to the rather increased temperature of the charge air. The oil 3 is less viscous at higher temperatures, and can therefore flow more readily in the feed channel 40. On the one hand, the suctioning effect of the ejector pump 50 is improved, and on the other hand the readiness of the charge air LL to transport the oil 3 away is improved.

Overall, a particularly simple and cost-effective solution for the return feed of oil 3 into the crankcase 30 is realized by the present embodiment. For this purpose, oil 3 from blow-by gas 1 is returned after encountering a pre-stage oil separator 13 of the ventilation housing part 10 in the material region 41, 42 of the crankcase 100—and particularly in the present case of the walls of the support housing part 20 and of the ventilation housing part 10. External conduits which were previously necessary can consequently be dispensed with. Due to the two horizontal sections I, II and the transverse section III, a return feed of the separated oil 3 occurs relatively near to the return feed of the separated oil 2 from the pre-stage oil separation in the ventilation housing part 10. This as well has proven particularly advantageous. Overall, the configuration enables a return feed of oil 2 and 3 into the crankcase 30 in close proximity—meaning in the walls—to the chambers 11, 12, and 22, with comparatively short conduit paths.

In one further embodiment not illustrated here, the return feed of the separated oil 2 can be realized from the further separation wall 16 and/or from the oil collection area 17 of the first chamber 11 and/or of the separation wall 14 of the second chamber 12 of the ventilation housing part 10, utilizing the second variant of the concept of the disclosure described above. According to the second variant, the concept according to the disclosure can also be implemented in the separation wall 14, by way of example. The concept can also be implemented in the oil collection area 17 and/or the further separation wall 16, by way of example. In other words, a further feed channel in the further separation wall 14, wherein said feed channel is not included in the drawing here, can be connected to the feed channel 40 described here in order to suction away oil in the direction of the ejector pump 50, following the pressure gradient to vacuum P2. In addition, a further feed channel can be included in the oil collection area 17 which leads to a further ejector pump, wherein the separated oil 2 can be sucked into said further feed channel, in order to feed the oil [2] back into the crankcase 30.

The present concept of the disclosure has been described in the context of the embodiment in the context of a two-stage oil separation, and has proven particularly suitable in this context—particularly for the purpose of suctioning separated oil 3 from a primary oil separation into a feed channel 40 in the direction of an ejector pump 50. However, the present concept can also be realized independently thereof, in a single-stage oil separation, meaning in an oil separation which does not include a pre-stage oil separation. In addition, the concept of the disclosure can be realized for the removal of separation oil 2 of a pre-stage oil separation. This can be realized, by way of example, by the integration of an ejector pump 50 with a feed channel into an oil collection area 17 or into an inclined wall 16 of the ventilation housing part 10.

In total, the concept of the disclosure in its most general form leads to a crankcase 100 having a comparatively compact design, and having walls in which the oil return feed route is already realized and generates a vacuum. In this case, it is advantageous that the oil return feed occurs essentially without the assistance of gravity, and functions reliably independently of the position of the crankcase 100.

What is claimed is:

1. A crankcase for an internal combustion engine, comprising:

a suction arrangement which is functionally assigned to the crankcase and which is configured to generate a limited vacuum in the crankcase to ventilate blow-by gas, and particularly a gas/oil mixture, from the crankcase;

at least one separation wall which is designed to convey blow-by gas and to separate off oil, wherein a ventilation housing part and a support housing part is arranged on the ventilation housing part, wherein the separation wall is constructed between the ventilation housing part and the support housing part, and wherein the suction arrangement is constructed in the form of an ejector pump and designed to suction off oil from the separation wall;

wherein a motive fluid stream of the ejector pump can be directly or indirectly fed, along with the oil to a crankcase interior of the crankcase, and particularly to a feed channel that leads to the crankcase interior via the ejector pump;

wherein the feed channel has a first horizontal section in the bottom wall of the support housing part, and a second horizontal section in the wall of the ventilation housing part, wherein the first and second horizontal section are connected to each other by a transverse section.

2. A crankcase according to claim 1, wherein the ventilation housing part is configured for separating oil, and includes a first and a second chamber in the ventilation housing part that are separated by a first oil separator.

3. A crankcase according to claim 2, wherein the first oil separator is constructed as a part of a further separation wall, particularly as a labyrinth separator or a fiber separator.

4. A crankcase according to claim 2, wherein the support housing part is configured to support at least one superstructural engine component that is in turn configured to supply a motive fluid stream to the ejector pump, and the ejector pump is configured to use the motive fluid stream to generate the limited vacuum in the crankcase.

5. A crankcase according to claim 2, further comprising a second oil separator that is supported by the support housing part, and the second oil separator is a cyclone separator.

6. A crankcase according to claim 1 wherein the support housing part is configured for an oil separation, and particularly a chamber for receiving oil is designed on the separation wall in the support housing part.

7. A crankcase according to claim 1, wherein the separation wall runs substantially horizontally between the ventilation housing part and the support housing part, wherein the separation wall has an oil collection area from which the feed channel proceeds, wherein the feed channel is configured to convey oil to the ejector pump.

8. A crankcase according to claim 1 wherein the separation wall is constructed as a bottom wall of the support housing part.

9. A crankcase according to claim 7, wherein the feed channel is at least partially integrated into the separation wall.

10. A crankcase according to claim 1 wherein a motive fluid stream comprising a charge fluid, comprising one of a supercharger air or another oil, fed to the ejector pump in such a manner that suctions off the oil from the separation wall.

11. A crankcase according to claim 1 wherein an additional further separation wall is constructed as a bottom edge of the ventilation housing part.

12. A crankcase according to claim 1 wherein the ejector pump is configured as a second suction arrangement in addition to the suction arrangement which is functionally assigned to the crankcase.

13. A crankcase according to claim 1 wherein a motive fluid stream of the ejector pump can be directly or indirectly fed, along with the oil to a crankcase interior of the crankcase, and particularly to a feed channel that leads to the crankcase interior via the ejector pump.

14. A crankcase according to claim 13, wherein the feed channel has a first horizontal section in the bottom wall of the support housing part, and a second horizontal section in the wall of the ventilation housing part, wherein the first and second horizontal section are connected to each other by a transverse section.

15. A crankcase according to claim 14, wherein the transverse section of the feed channel runs in a lateral wall of the ventilation housing part.

16. A crankcase according to claim 1 wherein the ventilation housing part and the support housing part are constructed as a single piece, and are integrated into the crankcase.

17. A crankcase for an internal combustion engine, comprising:

a first suction arrangement which is functionally assigned to a crankcase housing and which is designed for generating a limited vacuum in the crankcase to ventilate blow-by gas, and particularly a gas/oil mixture, from the crankcase;

at least one separation wall having a wall thickness that has a feed channel integrated therein, and the separation wall is configured to convey blow-by gas and separating oil;

wherein the separation wall has an oil receiving area disposed in a base region of a chamber which conveys blow-by gas; and a second suction arrangement is constructed in the form of an ejector pump that is integrated within the feed channel and configured to suction off oil from the separation wall.

18. A crankcase according to claim 1 wherein the ejector pump is a venturi fluid nozzle configured to receive a motive fluid stream, so as to draw the oil from the feed channel and return the oil to an interior of the crankcase.

19. A crankcase according to claim 1 wherein the feed channel is an internal passage extending through the wall thickness of the separation wall in a direction parallel to an outer surface of the separation wall.

* * * * *

UNITED STATES PATENT AND TRADEMARK OFFICE

CERTIFICATE OF CORRECTION

PATENT NO. : 9,151,195 B2
APPLICATION NO. : 13/882245
DATED : October 6, 2015
INVENTOR(S) : Mathias Stätter et al.

It is certified that error appears in the above-identified patent and that said Letters Patent is hereby corrected as shown below:

Title Page, item (57)

In the Abstract:

At column 2, line number 8, the word "in" is incorrect and should be deleted.

The sentence should read: "A ventilating housing part and a carrier housing part which is arranged above the ventilating housing part included in the crankcase."

Signed and Sealed this
Seventh Day of June, 2016

Michelle K. Lee

Michelle K. Lee
*Director of the United States Patent and Trademark Office*